United States Patent [19]

Smith et al.

[11] 3,960,049

[45] June 1, 1976

[54] REINFORCEMENT OF CAST OR PRESSED EXPLOSIVES

[75] Inventors: John H. Smith, Seaford; George S. Rogers, Williamsburg, both of Va.

[73] Assignee: The United States of America as represented by the Secretary of the Navy, Washington, D.C.

[22] Filed: Mar. 19, 1975

[21] Appl. No.: 559,858

[52] U.S. Cl. ..... 86/20 B; 86/1 R

[51] Int. Cl.[2] ..... F42B 13/00

[58] Field of Search ..... 86/1, 20 R, 20 B; 102/56

[56] References Cited

UNITED STATES PATENTS

| | | | |
|---|---|---|---|
| 2,940,390 | 6/1960 | Bergstrom et al. | 102/56 |
| 2,968,986 | 1/1961 | Swift et al. | 86/20 B |
| 2,977,885 | 4/1961 | Perry, Jr. et al. | 102/56 X |
| 3,000,308 | 9/1961 | Land et al. | 102/56 |
| 3,301,187 | 1/1967 | Donaldson et al. | 86/1 R |
| 3,311,013 | 3/1967 | Phipps | 86/20 R |

FOREIGN PATENTS OR APPLICATIONS

| | | | |
|---|---|---|---|
| 1,068,901 | 5/1967 | United Kingdom | 86/20 R |

*Primary Examiner*—Verlin R. Pendegrass

[57] ABSTRACT

Various synthetic, natural or metal fibers, in either random or selective orientation are cast or pressed in place within the explosive compositions to reinforce the explosives against cracking induced by service environments and thereby reduce the possibility of premature detonation or ignition within the gun bore.

2 Claims, 1 Drawing Figure

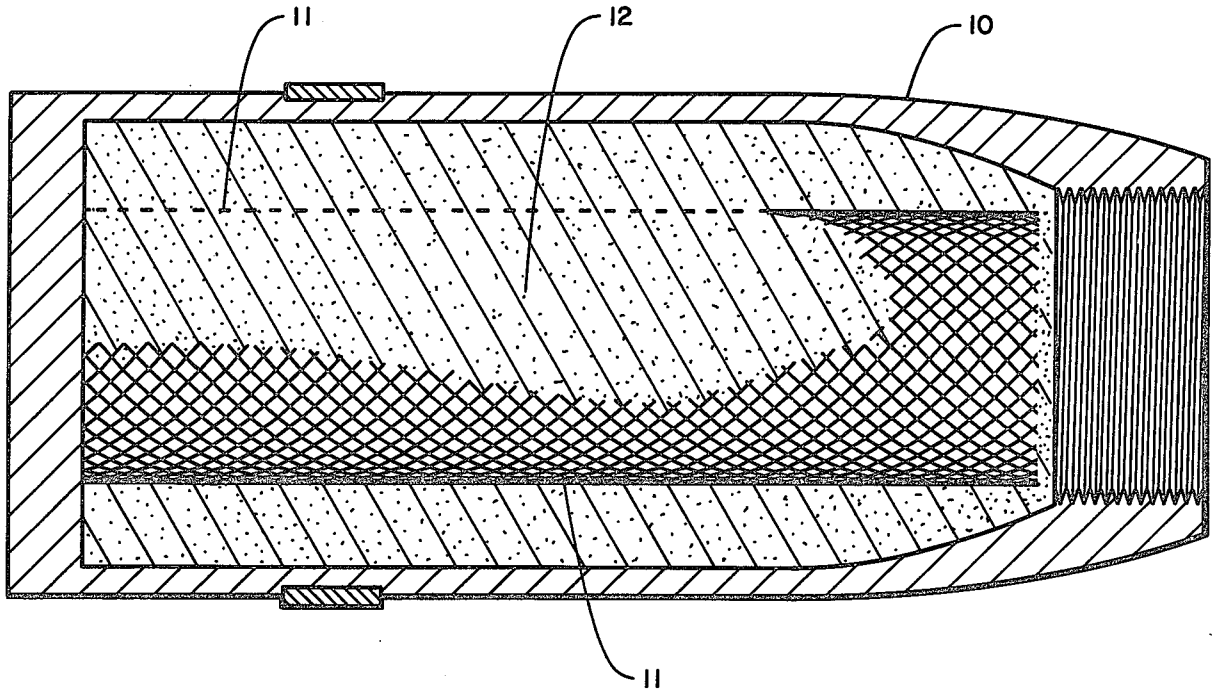
10
11
12
11

REINFORCEMENT OF CAST OR PRESSED EXPLOSIVES

BACKGROUND OF THE INVENTION

Explosive loads in ordnance items sometimes crack or degrade when they are subjected to environmental conditions, such as rough handling, temperature shock or even normal service use. These cracks thus formed are a source of pre-ignition or detonation when the explosive is exposed to service forces. Some conditions which also can contribute to pre-ignition are adiabatic compression of air or other gases trapped in voids such as would be produced by the formation of a cracking, or the effects of sliding surfaces, especially explosive surfaces with exposed cracks.

Explosive systems have been developed which are inherently more crack resistant than the conventional TNT-based explosive. Some systems had changes in composition such as substitution for TNT as a binder with plastic or resinous material. A binder is generally an elastomeric, resinous, or molten material in which the explosive particles are mixed. These explosive particles are generally solid crystals with little or no strength particle to particle. The "binder" acts as a glue between all the particles. The explosives designated by these changes are referred to as plastic bonded and are either pressed or cast systems. These systems, however, are expensive and economically adapted only to the more sophisticated weapon systems. The TNT systems are relatively inexpensive but have poor resistance to crack formation. With the use of the invention, improvements in strength are possible.

SUMMARY OF THE INVENTION

This invention consists of the use of reinforcing material within the cast or pressed explosive matrix of TNT based explosives. Without such reinforcement, the explosives have little strength when subjected to shear or tensile loads. Typical strengths are less than 100 psi in tension and 1200–1500 psi in compression. When an explosive with these characteristics is loaded into a weapon system and then subjected to normal handling forces or temperature cycling, the forces imposed on the explosive load would cause crack formations. By using this reinforcement system, the cracks are significantly reduced, if not eliminated, since the tensile strength of the explosive has been increased. The tensile strength is increased by two mechanisms: the explosive is held somewhat in compression, therefore, before it could stretch this compressive force has to first be overcome; and the fibrous material became the load carrying structure and the reinforcement, not the explosive, carried the load or resisted the forces tending to break or crack the explosive.

Various materials could be used: fibrous materials with relatively long length to diameter ratios, or perforated or woven material such as net, hemp, wire screen, expanded or perforated metal, aluminum fibre or any "cotton linters" material.

Rods or filaments prestressed and so fixed as to preload the explosive system in the compressive mode could be used. Any filamentary reinforcing material would work as long as it is compatible or does not cause any adverse reaction with the explosive or sensitize the explosives to an undesirable degree. The prime requirement other than compatibility is a high strength material of low stretch.

STATEMENT OF THE OBJECTS OF INVENTION

An object of this invention is to increase the strength and crack resistance of explosive loads in ordnance items through the use of filamentary reinforcing material disposed within the explosive.

Other objects, advantages and novel features of the invention will become apparent from the following detailed description of the invention when considered in conjunction with the accompanying drawing.

BRIEF DESCRIPTION OF THE DRAWING

The single FIGURE is a cross-sectional view of a projectile with the reinforcing material in place.

DETAILED DESCRIPTION OF THE INVENTION

The single FIGURE of the drawing shows a projectile 10 reinforced by a resin coated polyester net 11 prestressed and placed within the projectile cavity. On the casting of the explosive charge, the explosive 12 flows within and solidifies in the meshes of the net 11. Optimum placement of the net reinforces the explosive and provides resistance to both longitudinal and radial cracks.

In the initial test projectiles, the fibrous material was dacron string which was fastened to the base of the projectile by inserting it between the base fuze cavity plug and the base of the projectile. The string was then "led" out of the nose opening and pulled tight. A force of approximately 50 pounds was applied to the string. These projectiles were then melt cast loaded, that is, the explosive was melted and poured in the nose opening. When cool, the excess string was cut off. Tensile tests of this technique showed the strength of the explosive was increased by a factor of 10.

Subsequent improvements included the substitution of dacron net for string. The net was commercial laundry bag net and was purchased before being treatd with "size" for commercial use. This served to improve the strength in the transverse mode as well, that is, across the radius of the projectile. With the netting it was necessary to stretch the net outside the projectile. The net was sewn into tube form and then pulled over a teflon rod and coated with polyester resin. These preforms were held the place in he projectile by pouring a melted pad of filler in the base of the projectile. The net pre-form was inserted in the molten pool of inert material and allowed to cool. This "held" the net in place while the explosive was poured in. This same technique is applicable to the installation of any material, e.g., "cotton linters," hemp; wire net, perforated and expanded metal.

With the fibers in other forms or materials, different techniques of emplacement for reinforcement are required. A percentage of the reinforcement material was melt cast with the explosive system, that is "loose fibres"0 were in the melted explosives before the explosive was cast in the projectile. The percentage required is dependent on the degree of reinforcement required consistent with the effects on viscosity and performance. The amount required was a balance between all explosive or all reinforcement. Sufficient reinforcement was required to strengthen the explosive to withstand the forces placed upon it. It would be possible to estimate the number of strings required to withstand certain directed forces by measuring the tensile strength of a single strand and then including sufficient strands to contain the forces that would be encountered.

What is claimed is:

1. A method of reinforcing explosives against cracking comprising:

pouring a melted inert filler into a base of an ordnance item;

inserting one end of a pre-formed material of high strength and low stretch into said molten pool;

cooling said molten pool to fix the pre-form in its desired orientation;

pouring melted explosive into the ordnance item; and cooling said explosive.

2. The method of claim 1 including the steps of:

forming the pre-form of polyester net, prestressing the net, and coating the net with a resin to stiffen the pre-form in the desired shape prior to inserting the pre-form in the ordnance item.

* * * * *